US008056931B2

(12) United States Patent
Ali et al.

(10) Patent No.: US 8,056,931 B2
(45) Date of Patent: Nov. 15, 2011

(54) PRINTABLE MULTI-PART FORM

(75) Inventors: Sherif Ali, Los Angeles, CA (US); Kim Canchola, Lancaster, CA (US); Russell Smith, Newhall, CA (US); Tracy Tenpenny, Cedarburg, WI (US); Jeffrey Kerlin, Brookfield, WI (US); Mike Erwin, Mukwonago, WI (US); James Brown, Wind Lake, WI (US)

(73) Assignee: Precision Dynamics Corporation, San Fernando, CA (US)

( * ) Notice: Subject to any disclaimer, the term of this patent is extended or adjusted under 35 U.S.C. 154(b) by 709 days.

(21) Appl. No.: 12/137,862

(22) Filed: Jun. 12, 2008

(65) Prior Publication Data

US 2008/0309065 A1 Dec. 18, 2008

Related U.S. Application Data

(60) Provisional application No. 60/944,033, filed on Jun. 14, 2007, provisional application No. 60/980,858, filed on Oct. 18, 2007, provisional application No. 61/026,994, filed on Feb. 7, 2008.

(51) Int. Cl.
*G09F 3/04* (2006.01)

(52) U.S. Cl. ..... 283/105

(58) Field of Classification Search ..... 40/633; 283/81, 98, 106, 105
See application file for complete search history.

(56) References Cited

U.S. PATENT DOCUMENTS

| | | | | |
|---|---|---|---|---|
| 6,073,758 | A * | 6/2000 | Webster et al. | 206/6.1 |
| 6,888,502 | B2 | 5/2005 | Beigler et al. | |
| 2004/0113421 | A1 * | 6/2004 | Penuela et al. | 283/105 |
| 2004/0237367 | A1 * | 12/2004 | Ali | 40/633 |
| 2005/0108912 | A1 | 5/2005 | Bekker | |
| 2005/0279001 | A1 * | 12/2005 | Riley | 40/633 |
| 2006/0062955 | A1 * | 3/2006 | Liu et al. | 428/40.1 |

* cited by examiner

*Primary Examiner* — Dana Ross
*Assistant Examiner* — Matthew G Katcoff
(74) *Attorney, Agent, or Firm* — Kelly Lowry & Kelley, LLP

(57) ABSTRACT

A multi-part form includes a wristband with related tags and labels. The tags are configured for mounting on the wristband after the wristband has been secured to a person of object to be identified. The multi-part form is also configured with a wristband portion separate from a plurality of utility groups, each of which is separate from the other, by a street devoid of media layer. The layers that comprise the multi-part form are preferably solvent resistant so as to make the identification products more durable and longer lasting.

13 Claims, 7 Drawing Sheets

PRINTABLE MULTI-PART FORM

BACKGROUND OF THE INVENTION

The present invention relates to a printable multi-part form having a wristband and tags configured for subsequent attachment to the wristband. More particularly, the invention relates to a laser printable form including a wristband and related, configurable tags, wherein the tags are arranged into multiple utility groups. The materials that comprise the form also provide solvent resistant characteristics.

Printable forms including wristbands and related tags are generally known in the art. Such prior art forms require that the related tags be applied or affixed to the wristband at the time that the wristband is secured to the wearer. Such tags are securable to the wristband by slide-fit mounting into a pocket or a strap portion of the wristband. The requirement for pre-application of the related tags to the wristband can be disadvantageous at times, such as when the status of a hospital patient changes, i.e., DNR order, transfer to ICU, etc., and it needs to be identified on the wristband. Prior art wristbands require that a new wristband be applied in order to indicate such a change in status or similar information.

A common use for such identification wristbands and related tags is in a medical facility setting as discussed. The wristband may also be used for personal identification and/or access control at secured facilities. Other applications include access control at military bases, industrial installations, prisons and the like.

Prior art identification bands bearing or carrying wearer-related information in human readable or machine readable form are typically constructed from a relatively stiff plastic-based material. These wristbands are designed to provide sturdy and durable substrates suitable for permanent imprinting of information thereon. Plastic-based wristbands also effectively support and protect RFID circuitry and other electronic devices disposed therein. Barcodes are also protectable by an outer clear plastic layer or laminate. Unfortunately, such plastic-based wristbands can exhibit relatively abrasive or sharp edges. Hence, the wristbands tend to be uncomfortable to wear over extended time periods.

In addition, such bands may be exposed to solvents or other materials that can damage the wearer-related information or the band itself. Settings such as hospitals and industrial installations will contain chemicals and other solvents that can destroy the material of prior art bands. Other less industrialized locations, such as prisons, bars, etc., may also contain solvents that can break down prior art bands or damage the information printed thereon.

Accordingly, there is a need for a printable multi-part form including printable wristbands and related, wherein the tags can be applied to the wristbands after it is secured to a wearer. There is a further need for such multi-part form to be manufactured from solvent resistant materials. The present invention fulfills these needs and provides other related advantages.

SUMMARY OF THE INVENTION

The present invention comprises a printable multi-part form having both a wristband and a plurality of related tags. The printable, multi-part form comprises a wristband portion defining a wristband for secure attachment to a person or object to be identified. The multi-part form also comprises an adjacent tag portion defining a plurality of tags, wherein each tag includes a wristband attachment means for looped attachment of each tag to the wristband after the wristband is securely attached to a person or object.

The plurality of tags may be color coded, for example, red, yellow, and green tags. The plurality of tags has indicia associating them with the wristband. The indicia may be common to both the wristband and the tags. The wristband attachment means on the tags comprises a pressure sensitive adhesive and a removable tab, wherein the tags may be looped about the wristband and secured using the adhesive.

The multi-part form may be comprised of a printable media layer laminated to a liner layer. The form includes a wristband portion defining the wristband for identifying the person or object and an adjacent utility portion including the tags and/or a plurality of labels having wristband associating indicia. The media layer is discontinuous between the wristband portion and the utility portion such that a street is formed therebetween. A street is an exposed portion of the liner layer devoid of media layer. The tags and labels are arranged into a plurality of utility groups, each utility group including a contiguous plurality of labels and/or tags. Each of the plurality of utility groups are discontinuous from adjacent utility groups such that a street is formed therebetween.

The multi-part form comprises a solvent resistant liner layer bonded to a printable media layer by an intermediate adhesive layer that is substantially co-extensive with the media layer. The multi-part form is separated into a wristband portion defining a wristband and a label portion defining a plurality of labels. The wristband is defined by a cut that passes through the media layer and the liner layer. The plurality of labels is defined by a plurality of cuts through the media layer and having a release layer underlying the media layer of each of the plurality of labels.

The printable media layer of the wristband portion is comprised of a solvent resistant material. The solvent resistant material may comprise a synthetic paper material or a paper material having a solvent resistant overcoat. The solvent resistant overcoat may comprise a UV curable polymer or an acrylic polymer. The media layer of the label portion may comprise the same material as the media layer of the wristband portion.

The media layer is preferably discontinuous between the wristband portion and the label portion such that a street is formed therebetween. The label portion preferably comprises a plurality of label groups, each label group including a contiguous plurality of labels and each of the plurality of label groups are discontinuous from adjacent label groups such that a street is formed therebetween.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
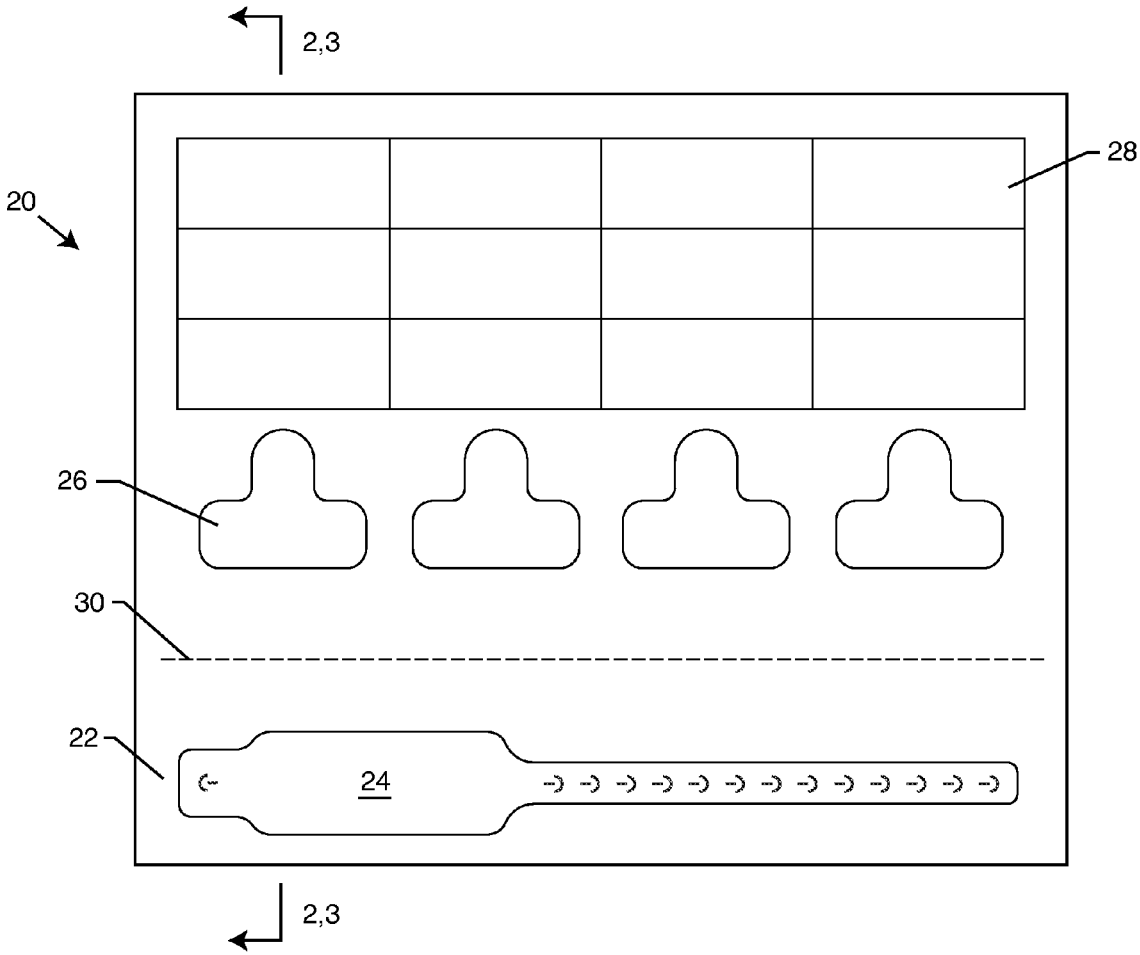
FIG. 1 is a face view of a printable multi-part form including a wristband, a plurality of adhesive tags, and a plurality of labels.

As shown in the drawings for purposes of illustration, a printable multi-part form embodying the invention is referred to generally by the reference number 20. FIG. 1 illustrates the printable multi-part form 20 including a wristband portion 22 defining a wristband 24, a plurality of tags 26 and a plurality of labels 28. The wristband portion 22 may be separable from the plurality of tags 26 and labels 28 by a score line 30. The score line 28 allows detachment of the wristband portion 22 of the multipart form 20 from the portion of the multipart form 20 carrying the tags 26 and labels 28. The multipart form 20 is capable of being fed through any one of a number of different standard printers, including laser printers, ink jet printers, or dot matrix printers. It is preferred in the present invention that the multi-part form 20 be used in conjunction with a laser printer to deposit printed indicia on the wristband 24, tags 26 and labels 28. Utilization with a dot matrix printer may require a plurality of feed apertures (not shown) along the side of the form 20.

Figure 2:
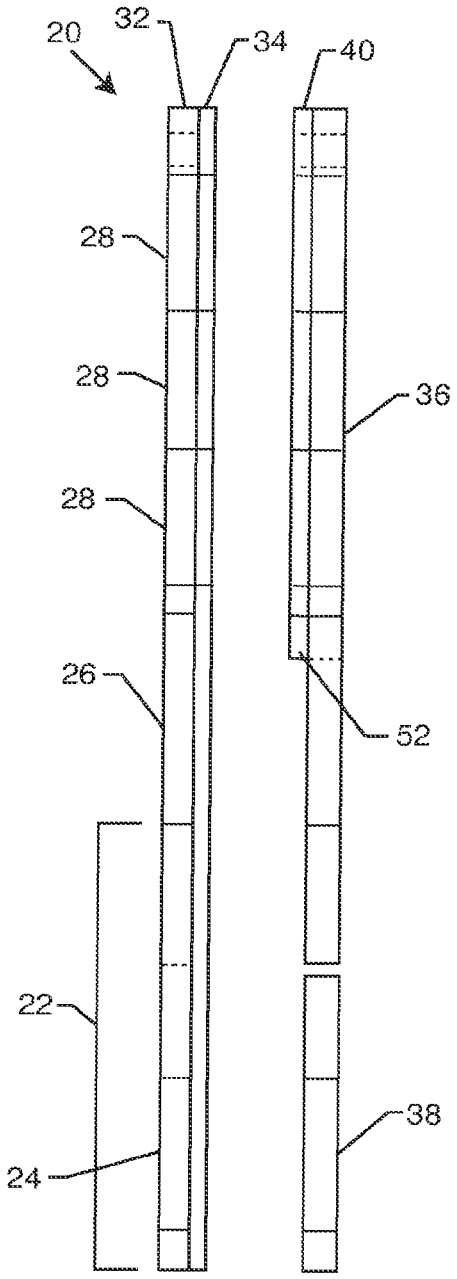
FIG. 2 is a cross-sectional view of the printable multi-part form taken along line 2-2 of FIG. 1.
Figure 3:
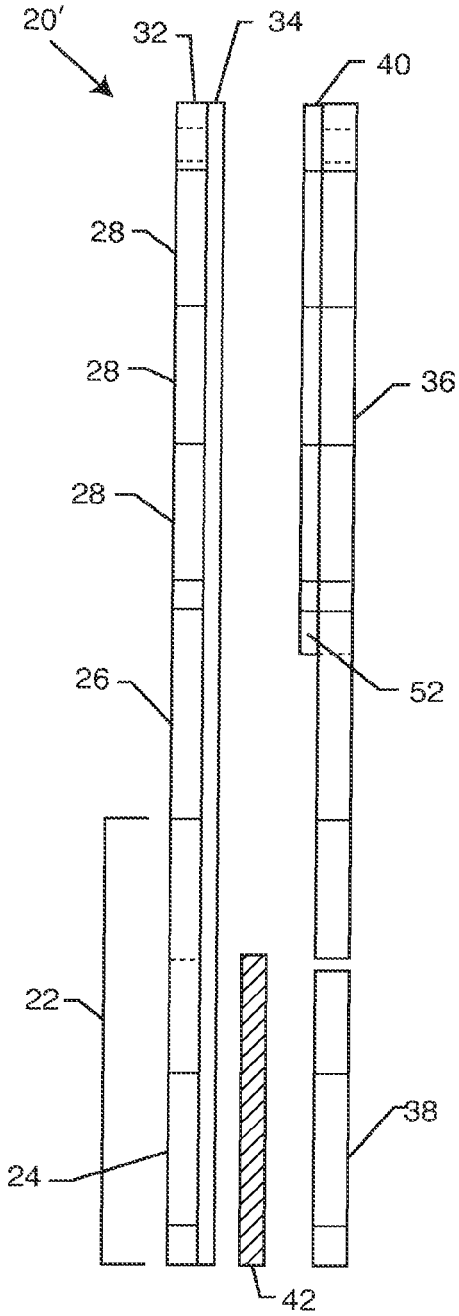
FIG. 3 is a cross-section view of an alternate embodiment of the printable multi-part form taken along line 3-3 of FIG. 1.

FIGS. 2 and 3 illustrate cross-sectional views of the multi-part form 20 disclosing an enlarged view of the layers thereof. The multi-part form 20 in FIG. 2 is bi-laminated, while the multi-part form 20' of FIG. 3 is tri-laminated. With reference to FIG. 2, the top layer 32 of the multi-part form 20 is generally formed from a face stock comprising paper or plastic. Specifically, the top layer 32 may comprise 1.1 mil white polypropylene film with an acrylic adhesive, a top coat polyamide, printable cloth, or laser-printable paper. The top layer 32 is capable of receiving printed indicia from a printer as described above. Underneath the top layer 32 is an adhesive layer 34. The adhesive layer 34 functions to retain the top layer 32 next to an adjacent release liner 36 and plastic liner 38. The adhesive layer 34 preferably covers the entire surface area underneath the top layer 32. The plastic liner 38 underlies the wristband portion 22 and the tags 26 and therefore abuts the top surface of an identified object. The plastic liner 38 preferably comprises either a polypropylene film with acrylic adhesive or an embossed polyethylene. The release liner 36 underlies the labels 28 and is separable from the adhesive layer 34 via a release coating 40. Removal of the release liner 36 with the release coating 40 exposes the adhesive layer 34 on the labels so that they may adhere to a surface.

The tri-laminated multi-part form 20' illustrated in FIG. 3 has a similar construction to the bi-laminated multi-part form 20 illustrated in FIG. 2. It includes a top layer 32 laminated to a release liner 36 and a plastic liner 38 by an intermediate adhesive layer 34. It also includes the release layer 40 underlying the labels 28. The tri-laminated multi-part form 20' includes and additional comfort liner 42 between the adhesive layer 42 and the plastic liner 38. The comfort liner 42 effectively forms a third layer in the wristband to enhance wearer comfort, especially important in a hospital setting.

Preferably the wristband 24 is manufactured from a single sheet stock and would exist as a single component to better facilitate its removal from the multi-part form 20. Although multiple components or multiple layers may be used to form the wristband 24 of the present invention.

In general, the multi-part form 20 of the present invention provides a low-cost identification band that is capable of receiving print-on-demand RFID, barcode, or human readable information. The multi-part form 20 is preferably designed for use in hospitals. For example, the multi-part form 20 is used for positive patient identification for medical administration, patient care identification, and medical alerts, including allergies, fall risks, and do not resuscitate orders. The multi-part form 20 can also be used in the maternity ward to coordinate the association of mothers and infants. For example, the multi-part form 20 may include multiple wristband 24 correspondingly applied to a mother and infant at birth. Each wristband contains information regarding both the mother and the infant. Furthermore, the tags 26 and labels 28 can be added to the mother or infant wristband 20 post application, as is more fully described herein.

Furthermore, the wristband 24, tags 26 and labels 28 are easy to use such that medical personnel may simultaneously print the multi-part form 20 at the same time as other medical records, i.e., admission papers. Accordingly, the multi-part form 20 and any corresponding attachments are affixed to a patient medical folder simultaneously with the medical records.

While the multi-part form 20 is preferably used in the hospital setting, a person of ordinary skill in the art will readily appreciate that the multi-part form 20 with corresponding wristband 24, tags 26 and labels 28 have multiple applications outside the hospital setting. For example, the wristband 24 could be used to identify persons at amusement parks, restaurants, bars, clubs, tours, businesses, sporting events, or any other area, building or location wherein persons are identified. The tags 26 and labels 28 may also be used in any of these applications in conjunction with the wristband 24. In one example, a person receives an identification wristband 24 at an airport and the tags 26 or labels 28 are attached to the wearer's luggage. The wristband 24 associates identification of the passenger with the passenger's luggage.

Figure 4:
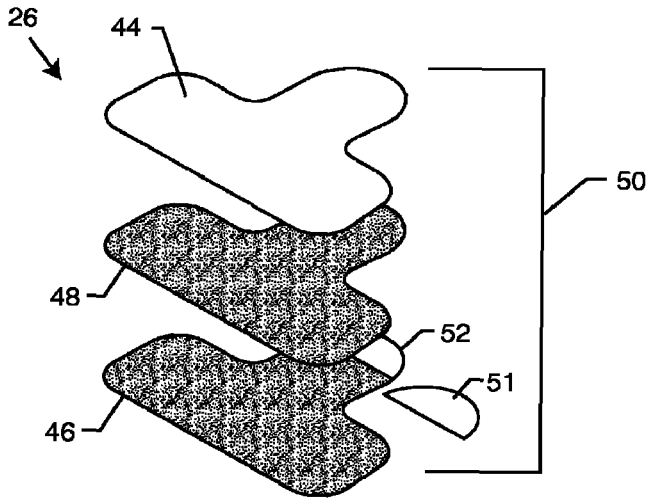
FIG. 4 is an exploded perspective view of an adhesive tag of the present invention.
Figure 5:
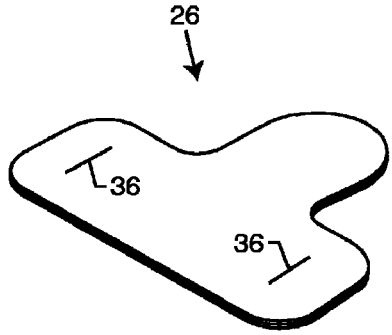
FIG. 5 is a perspective view of an adhesive tag of the present invention including a pair of slits.
Figure 6:
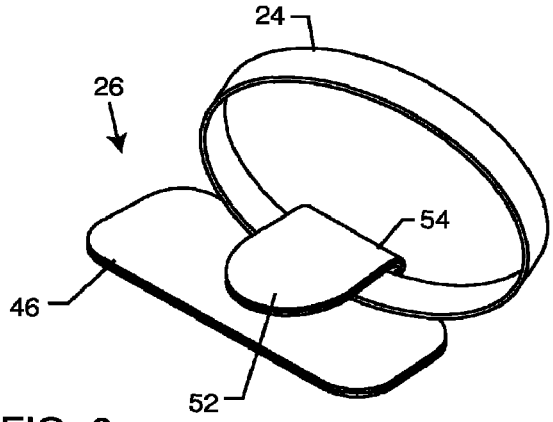
FIG. 6 is a perspective view of an adhesive tag of the present invention illustrating the adhesive looped feature.

FIGS. 4 through 6 illustrate the structure and utilization of the tags 26. As shown in FIG. 4, the tag 26 has a top layer 44 and a bottom layer 46. The top layer 44 corresponds to the top layer 32 and the bottom layer 46 corresponds to the release liner 36—both shown in FIGS. 2 and 3. The top layer 44 is adhered to the bottom layer 46 by an adhesive layer 48 disposed therebetween, which corresponds to the adhesive layer 34 described above. The tag 26 includes a tab portion 50 which includes a release coating 52, as shown. This release coating 52 corresponds to the release coating 40 described above and shown in FIGS. 2 and 3.

In application, the release coating 52 permits a portion 51 of the bottom layer 46 to be peeled away and removed exposing the adhesive layer 48 disposed along the underside of the tab portion 50 of the top layer 44. The exposed adhesive layer 48 allows the tab portion 50 to fold back upon the bottom layer 46, as generally shown in FIG. 6, to effectively create a loop 54 through which the wristband 24 can pass. The tag 26 is designed to be attached to the wristband 24 after it has been secured to a person or object. Therefore, the loop 54 created by folding the tab portion 50 back onto the bottom layer 46 is created around the already secured wristband 24. The exposed adhesive layer 48 on the bottom of tab portion 50 may also be used to directly adhere the tag 26 to the wristband 24 or another object to be identified. The tag 26 may be color coded to correspond to specific medical alerts, such as allergies, fall risks, and do not resuscitate orders. Colors may include green, yellow and red, among other coded colors.

Alternatively, the tag 26 in FIG. 5 illustrates a pair of slits 56 located at opposite ends of the tag 26. The slits 56 are used to thread the tag 26 lengthwise along the wristband 24. Of course, the tag 26 must be threaded prior to application of the wristband 24 around an object to be identified. One advantage of the adhesive layer 48 underlying the tab portion 50 is that the tag 26 may be adhered to the wristband 24 at any time without physical removal of the wristband 24 from the identified person or object. The tags 26 of the present invention are particularly preferred for applications of infant identification. Infants are typically identified with a wristband at birth and before separation from the mother. The present invention allows for additional tags to be added to the infant or mother wristband without removing the wristband 24. Therefore, the wristbands 24 may carry additional identifying barcodes or human readable indicia after application. The tag 26 is large enough that the curvature of the wristband 24 around an infant's wrist will not interfere with the scanability or readability of identifying information, i.e., a barcode.

Figure 7:
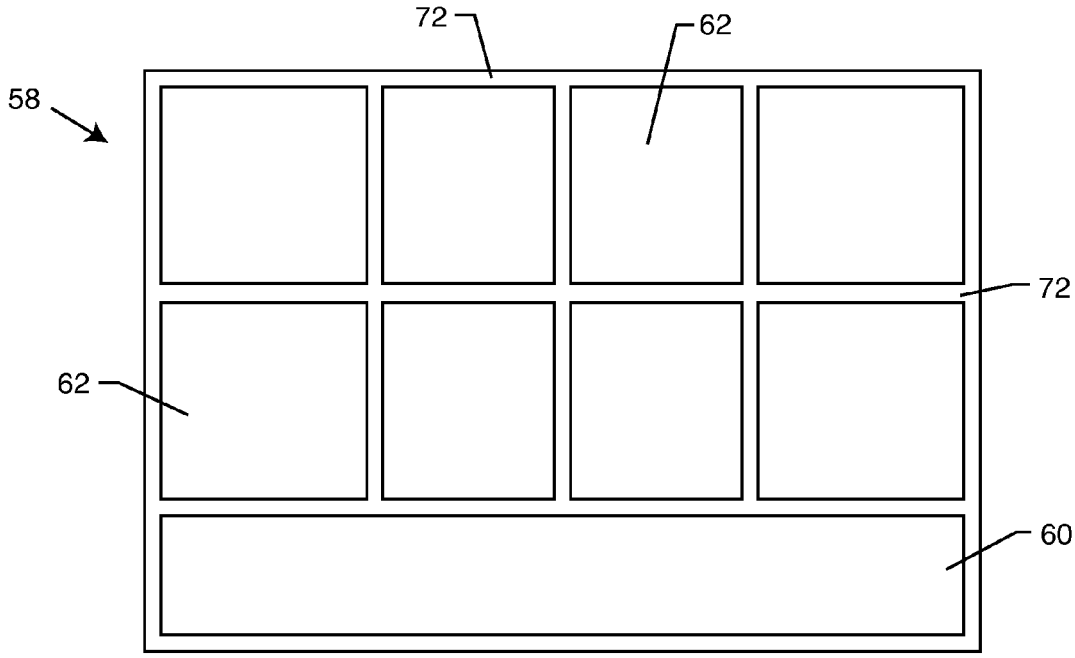
FIG. 7 is an illustration of a multi-part form according to the present invention including a wristband portion and a plurality of utility groups.
Figure 8:
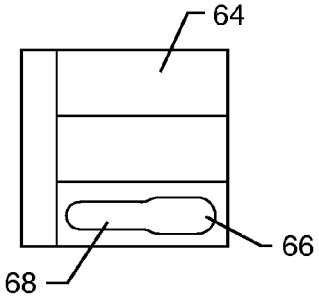
FIG. 8 is an illustration of a utility group for the multi-part form in FIG. 7.
Figure 9:
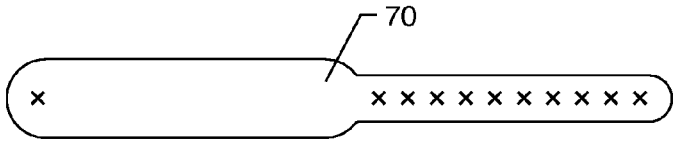
FIG. 9 is an illustration of a wristband for the multi-part form in FIG. 8.

As shown in FIGS. 7 through 9, another embodiment of a multi-part form 58 configured for being fed through a printer, the form is divided into different regions or portions including a wristband portion 60 and a plurality of label portions or utility groups 62.

As with the previous embodiment, the wristband portion 60 includes a wristband 70 having an outline defined by a die cut that passes through all layers of the form 58. As shown in FIG. 8, the plurality of label groups 62 include a plurality of labels 64 and in some cases a colored tag 66. The labels 64 include an underlying release layer as described above so that they can be separated from the multi-part form 58 and adhered to a desired surface. The colored tags 66 are defined by an outline of a die cut that passes through the all layers of the form 58. The colored tags 66 include one end of a tab portion 68 with an underlying release layer, as described above, so that the tag 66 may be looped around a portion of a wristband 70, also as described above.

The wristband portion 60 and label groups 62 are arrayed on the multi-part form 58 such that streets 72 separate each label group 62 from one another and from the wristband portion 60. The streets 72 comprise regions of a plastic liner layer that are devoid of a printable media layer which comprises the wristband portion 60 and label groups 62, as described more fully below. The streets 72 clearly demarcate the label groups 62 into different types of labels 64 and/or tags 66. Preferably, the underlying plastic liner layer is clear so that the streets 72 are more pronounced for clearer demarcation. However, the streets 72 will provide the same benefits described below when the plastic liner layer is white or another color. The benefit from demarcation by the streets 72 is two-fold.

The demarcation by streets 72 allows for different types of information to be printed on different label groups 62 with each label group being clearly distinguishable. The ability to print different types of information on different label groups 62 makes it possible to provide a wider variety of identification labels to accommodate a wider variety of needs. For example, a health care facility may print multiple label groups 62 with information necessary to identify tissue and/or fluid samples and a different set of label groups 62 with information to identify patient files or personal items. Each label group 62 includes a contiguous plurality of labels such that labels 64 bearing similar types of identifying information are easily identified by a practitioner. This identification of label groups 62 and demarcation by the streets 72 decreases the possibility of a practitioner making a mistake and applying an incorrect type of identifying label 64 or tag 66.

This demarcation also improves the printability of the multi-part form 58. By creating the streets 92 devoid of the printable media layer, portions of such printable media layer that span the entire width and/or length of the multi-part form 58 are eliminated. The elimination of such spanning printable media layer reduces and/or eliminates curl in the multi-part form 58 that results from passage through a laser printer or similarly hot device. Contiguous spans of printable media layer on a form configured for passage through a printer or other heating device cause the form to curl. Interruption of the printable media layer with the streets 72 through the interior and around the perimeter of the multi-part form 58 eliminates this curl.

Figure 10:
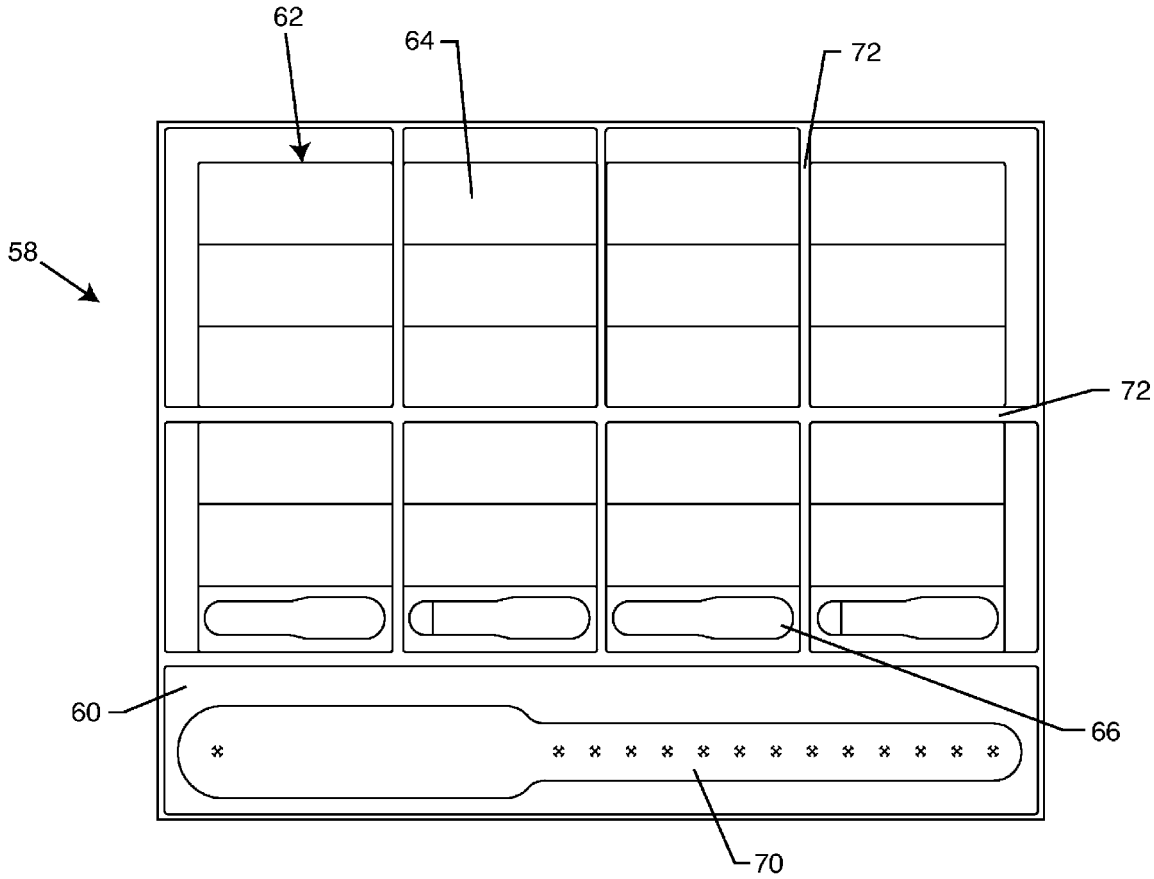
FIG. 10 is face view of a multi-part form including the label groups and wristband of FIGS. 8 and 9.

FIG. 10 illustrates an assemblage of the multi-part form 58 including the wristband portion 60, including the wristband 70, and the label groups 62 including the labels 64 and tags 66. The streets 72 between the wristband portion 60 and each of the label groups 62 is also shown.

Figure 11:
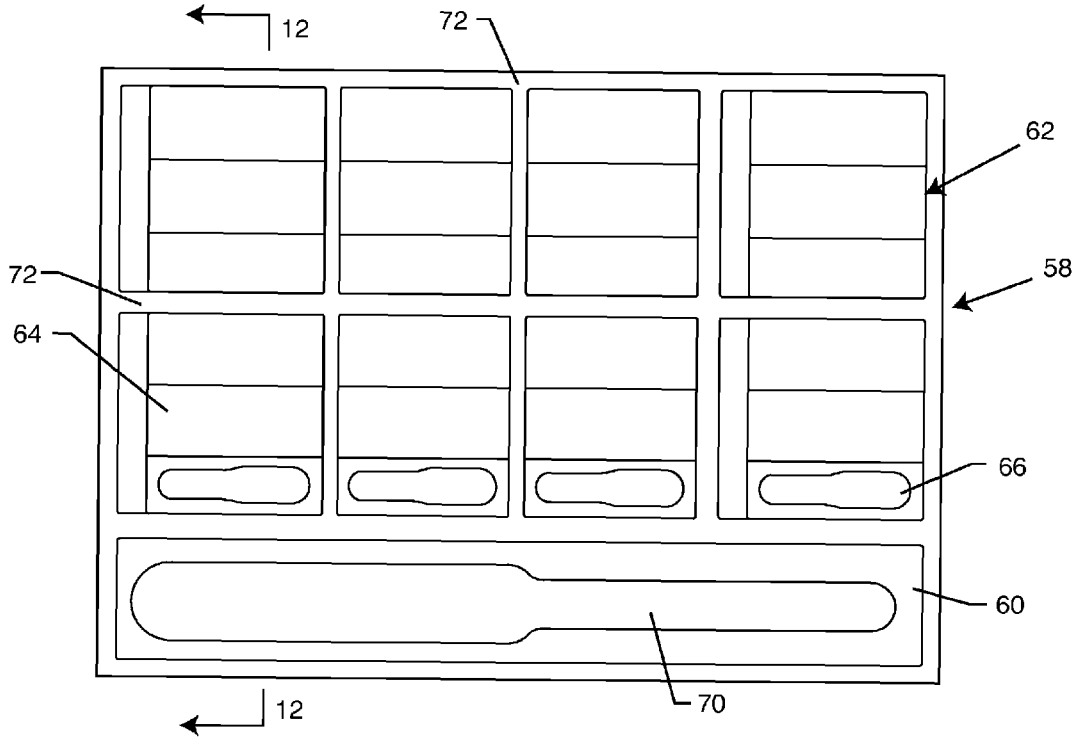
FIG. 11 is a face view of an alternate embodiment of the multi-part form of the present invention.
Figure 12:
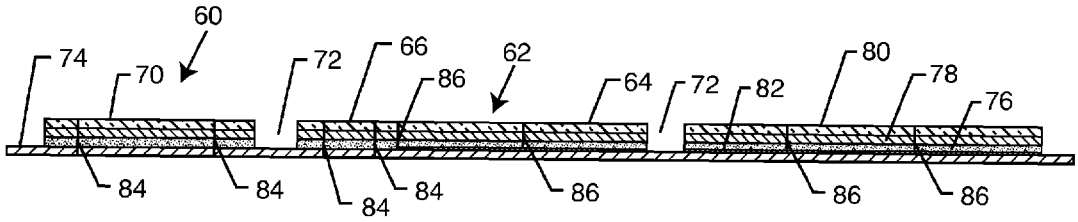
FIG. 12 is a cross-sectional view taken along line 12-12 of FIG. 11.

FIGS. 11 and 12 illustrate a specific embodiment of the multi-part form 58. FIG. 11 depicts a multi-part form 58 similar to that shown in FIG. 10 having wristband portion 60 and label groups 62 as well as streets 72. FIG. 12 shows a cross-section of FIG. 11 taken along line 12-12 and illustrates the different layers that comprise the multi-part form 58. The form has a liner layer 74 preferably made from polyethylene terephthalate (PET). An adhesive layer 76 adheres the liner layer 74 to a printable media layer 78. A solvent-resistant overcoat 80 is deposited on top of the media layer 78. A release layer 82 is placed between the liner layer 74 and the adhesive layer 76 under those portions of the media layer 78 corresponding to labels 64.

The wristband 70 and colored tags 66 are defined by die cut lines 84 that extend through all of the layers of the multi-part form 58. There is no release layer 82 underlying the wristband 70 or the tags 66 over at least most of the area of the wristband and the tags. Therefore, all of the layers of the wristband 70 and tags 66 are permanently bonded together except for the release coating 52 described above and similar structures relating to attachment mechanisms. The labels 64 are defined by die cut lines 86 that extend through the adhesive layer 76, media layer 78 and overcoat 80.

The solvent resistant overcoat 80 comprises a clear plastic laminate to protect a printable paper media layer 78 from solvents, moisture and chemicals. In the embodiment illustrated in FIGS. 11 and 12, the overcoat 80 is a UV curable acrylic but other materials such as urethanes may provide similar functionality. The overcoat 80 protects the paper media layer 78 against exposure to the environment and any printable information from a laser printer or similar device is printed on top of the overcoat 80. Printed information deposited by a laser printer or similar device may fuse down into or otherwise bond to the solvent resistant overcoat layer 80.

Therefore, the overcoat 80 provides solvent protection for the media layer and provides high adhesion and durability for the printed information.

Figure 13:
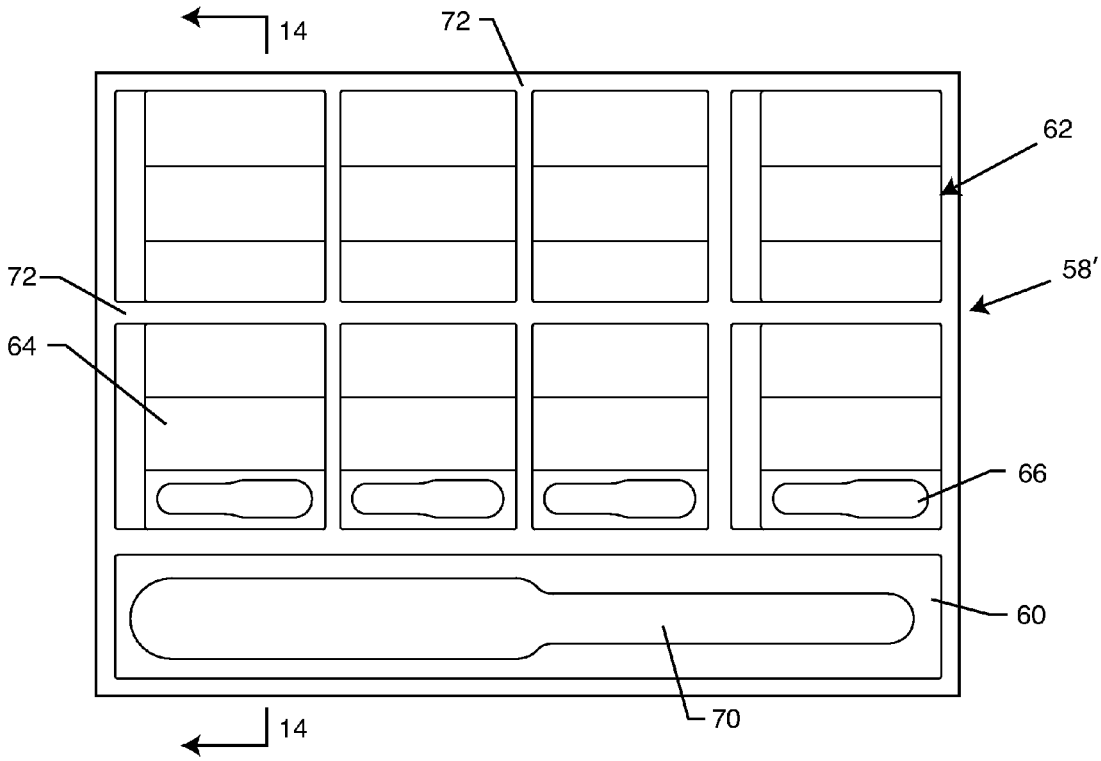
FIG. 13 is a face view of another alternate embodiment of the multi-part form of the present invention.
Figure 14:
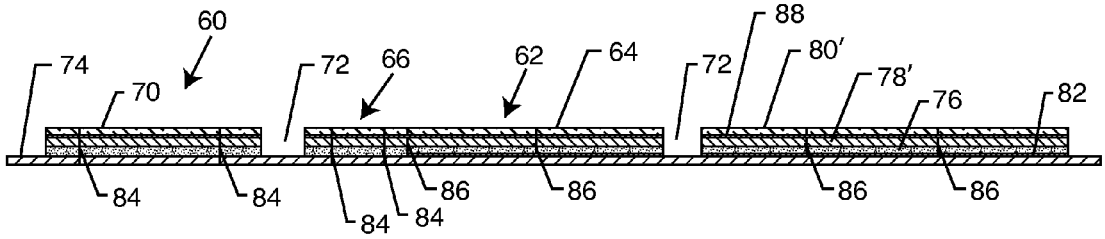
FIG. 14 is a cross-sectional view taken along line 14-14 of FIG. 13.

FIGS. 13 and 14 illustrate an alternate embodiment for the multi-part form 58' similar to the embodiment in FIGS. 11 and 12, including a liner layer 74, an adhesive layer 76, a media layer 78', and an overcoat 80'. The multi-part form 58' also includes dies cuts 84 and 86 to separate the wristband 70, labels 64 and tags 66. In this embodiment, the media layer 78' is made from synthetic paper, i.e., formulated from polymers such as polypropylene, or a combination of polymers and paper materials. In some cases, the synthetic paper media layer 78' may require a toner receiving overcoat 80' to assure that printer toner will adhere properly to the synthetic paper media layer 78'. In addition, a primer layer 88 may be required to bond or tie the overcoat layer 80' to the synthetic paper media layer 78'. In an alternative embodiment, a synthetic paper media layer 78' that is laser printable eliminates the need for the overcoat 80' and the primer layer 88.

Preferably, the liner layer 74 in the multi-part form 58, 58' is comprised of materials resistant to solvents. The polyethylene material described above provides adequate solvent resistant characteristics. In addition, the media layer 78, 78' is also comprised of materials resistant to solvents. The previously described materials, such as, a paper media layer 78 with a solvent resistant overcoat 80 or a synthetic paper media layer 78' made from polymers such as polypropylene or a combination of such polymers with paper provide adequate solvent resistant characteristics.

Although several embodiments have been described in detail for purposes of illustration, various modifications may be made without departing from the scope and spirit of the invention. Accordingly, the invention is not to be limited, except as by the appended claims.

What is claimed is:

1. A printable, multi-part form, comprising:

a wristband portion defining a wristband for secure attachment to a person or object to be identified;

an adjacent tag portion defining a plurality of tags, wherein each tag includes a wristband attachment means for looped attachment of each tag to the wristband after the wristband is securely attached to a person or object, said wristband attachment means comprising a pressure sensitive adhesive and a removable tab wherein the tag is configured to be wrapped around the wristband and the pressure sensitive adhesive adhered to a portion of the tag to form the looped attachment;

a solvent resistant liner layer bonded to a printable media layer by an intermediate adhesive layer that is substantially co-extensive with the media layer;

wherein the media layer is discontinuous between the wristband portion and the label portion such that a street devoid of printable media layer is formed therebetween;

wherein the multi-part form is separated into a wristband portion defining a wristband and a label portion defining a plurality of labels, the wristband defined by a cut that passes through the media layer and the liner layer such that the liner and media layers within the defined wristband are permanently bonded together and removable from the multipart form as a whole, and the plurality of labels defined by a plurality of cuts through the media layer, but not the liner layer, and having a release layer underlying the media layer of each of the plurality of labels such that the liner and media layers within the defined labels are releasably bonded together and only the media layer is removable from the multi-part form.

2. The multi-part form of claim 1, wherein the plurality of tags are colored.

3. The multi-part form of claim 2, wherein the plurality of tags comprise red, yellow, and green tags.

4. The multi-part form of claim 1, wherein the plurality of tags have indicia associating them with the wristband.

5. The multi-part form of claim 4, including common indicia on both the wristband and the tags.

6. The multi-part form of claim 1, wherein the tags and labels are arranged into a plurality of utility groups, each utility group including a contiguous plurality of labels and/or tags.

7. The multi-part form of claim 6, wherein the media layer between each of the plurality of utility groups is discontinuous such that a street devoid of printable media layer is formed therebetween.

8. The multi-part form of claim 1, wherein the printable media layer of the wristband portion is solvent resistant.

9. The multi-part form of claim 8, wherein the media layer of the wristband portion comprises a paper material having a solvent resistant overcoat.

10. The multi-part form of claim 9, wherein the solvent resistant overcoat comprises a UV curable polymer or an acrylic polymer.

11. The multi-part form of claim 9, wherein the media layer of the label portion comprises the same material as the media layer of the wristband portion.

12. The multi-part form of claim 1, wherein the label portion comprises a plurality of label groups, each label group including a contiguous plurality of labels.

13. The multi-part form of claim 12, wherein the media layer between each of the plurality of label groups is discontinuous such that a street devoid of printable media layer is formed therebetween.

* * * * *